US009539520B2

(12) United States Patent
Rotbard et al.

(10) Patent No.: US 9,539,520 B2
(45) Date of Patent: Jan. 10, 2017

(54) MANIPULATABLE CONSTRUCTION TOY SET FOR TODDLERS, YOUNG CHILDREN AND OTHERS

(71) Applicants: Eric J. Rotbard, West Nyack, NY (US); Bruce P. Popek, South Windsor, CT (US); Richard F. Andrus, Monterey, MA (US)

(72) Inventors: Eric J. Rotbard, West Nyack, NY (US); Bruce P. Popek, South Windsor, CT (US); Richard F. Andrus, Monterey, MA (US)

( * ) Notice: Subject to any disclaimer, the term of this patent is extended or adjusted under 35 U.S.C. 154(b) by 0 days.

(21) Appl. No.: 15/050,086

(22) Filed: Feb. 22, 2016

(65) Prior Publication Data

US 2016/0166945 A1 Jun. 16, 2016

Related U.S. Application Data

(63) Continuation of application No. 14/513,367, filed on Oct. 14, 2014, now abandoned.

(60) Provisional application No. 61/889,961, filed on Oct. 11, 2013.

(51) Int. Cl.

| | |
|---|---|
| ***A63H 33/10*** | (2006.01) |
| ***A63H 33/08*** | (2006.01) |
| ***A63H 33/04*** | (2006.01) |
| ***A63H 3/16*** | (2006.01) |

(52) U.S. Cl.

CPC ..... *A63H 33/088* (2013.01); *A63H 3/16* (2013.01); *A63H 33/042* (2013.01); *A63H 33/10* (2013.01)

(58) Field of Classification Search

CPC ..... A63H 3/00; A63H 3/16; A63H 3/46; A63H 33/00; A63H 33/065; A63H 33/101; Y10T 24/45099; Y10T 29/49876; Y10T 403/32196; Y10T 403/32975

USPC ..... 446/97, 99, 102, 104

See application file for complete search history.

(56) References Cited

U.S. PATENT DOCUMENTS

| | | | | |
|---|---|---|---|---|
| 2,752,726 | A | 7/1956 | Calvertey | |
| 4,217,724 | A | 8/1980 | Schoenfield et al. | |
| 4,589,853 | A | 5/1986 | Hidvegi | |
| 4,619,625 | A | 10/1986 | Seki et al. | |
| 4,631,040 | A | 12/1986 | Shiraishi | |
| 4,798,553 | A | 1/1989 | Gentles et al. | |
| 4,925,429 | A | 5/1990 | Kaulfuss et al. | |
| 5,104,345 | A | 4/1992 | Lyman | |
| 5,378,184 | A | 1/1995 | Bro et al. | |
| 5,752,869 | A * | 5/1998 | Huff | A63H 3/16 446/102 |

(Continued)

*Primary Examiner* — Kien Nguyen

(74) *Attorney, Agent, or Firm* — Law Office of Leo Zucker

(57) ABSTRACT

A construction toy set includes a number of pieces of different shapes and colors which are configured to allow a user to construct a desired object or model by connecting selected pieces to one another. One of the pieces is a first joint piece constructed to connect two other pieces of the set for relative rotational movement about an axis of the piece. The joint piece has a body formed of two parts that are joined to one another for relative rotation about the joint piece axis, and each part is configured to connect to another piece of the set. The set also includes a second joint piece constructed to connect two other pieces of the set for relative rotational movement about two orthogonal axes of the piece. The bodies of the joint pieces emit a pleasant click sound when the parts of the bodies are turned by the user.

23 Claims, 19 Drawing Sheets

(56) References Cited

U.S. PATENT DOCUMENTS

| | | | |
|---|---|---|---|
| 6,062,941 | A | 5/2000 | Cook |
| 8,087,970 | B2 | 1/2012 | Sambenedetto |
| 8,408,962 | B2 | 4/2013 | Sambenedetto |
| 2008/0096458 | A1 | 4/2008 | Andersen |
| 2010/0041300 | A1 | 2/2010 | Bevirt |

* cited by examiner

MANIPULATABLE CONSTRUCTION TOY SET FOR TODDLERS, YOUNG CHILDREN AND OTHERS

CROSS-REFERENCE TO RELATED APPLICATIONS

This application is a continuation of copending U.S. patent application Ser. No. 14/513,367 filed Oct. 14, 2014, titled "Construction Toy Set For Toddlers and Young Children." The '367 application claims priority under 35 U.S.C. §119(e) U.S. Provisional Patent Application No. 61/889,961, filed Oct. 11, 2013, titled "Construction Toy With X/Y Rotating and Clicking Connectors."

BACKGROUND OF THE INVENTION

Field of the Invention

The present invention relates to toys, particularly construction toy sets for toddlers or young children.

Discussion of the Known Art

Construction toy sets for toddlers and young children usually include pieces or blocks that can fit with one another to create a static model or object, e.g., a house, a building, and the like. Typically, the finished object is not one with which the child can actively play or interact, however, other than by disassembling it and arranging the pieces or blocks to create a different object. Toy sets that allow for greater interaction between a child and an assembled object are aimed mostly at older players. See, e.g., U.S. Pat. No. 8,408,962 (Apr. 2, 2013), U.S. Pat. No. 4,631,040 (Dec. 23, 1986), and U.S. Pat. No. 4,217,724 (Aug. 19, 1980).

U.S. Pat. No. 8,087,970 (Jun. 5, 2006) discloses a toy construction system comprised of a multitude of interconnecting members including a rotatable connector/spinner device. The spinner device is made so that when other members of the system are joined to the device, the members can turn or rotate about an axis of the device.

Notwithstanding the known art, there is a need for a construction toy set for toddlers and young children that provides sensory stimulation in terms of touch, feel, and sound, both when the child is assembling pieces of a desired object, and when he or she plays with the object once assembled. There is also a need for a construction toy set for toddlers and young children that stimulates creativity by encouraging the child to build an object using particular shapes and features of different pieces that are provided with the set.

SUMMARY OF THE INVENTION

According to the invention, a construction toy set includes a number of pieces having different shapes, and which are configured to enable a child or other user to construct a desired object or model by connecting selected pieces to one another. One of the pieces is a first joint piece having an axis, and the joint piece is constructed and arranged to connect first and second other pieces of the toy set to one another for relative rotational movement about the axis of the piece. The first joint piece has a body comprised of two parts that are joined to one another for relative rotation about the axis of the first joint piece. One part of the joint piece body is configured to connect to the first other piece of the toy set, and the other part of the joint piece body is configured to connect to the second other piece of the toy set.

For a better understanding of the invention, reference is made to the following description taken in conjunction with the accompanying drawing and the appended claims.

BRIEF DESCRIPTION OF THE DRAWING FIGURES

Figure 6B:
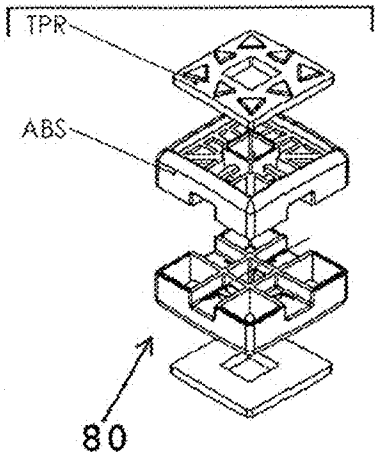
Figure 6A:
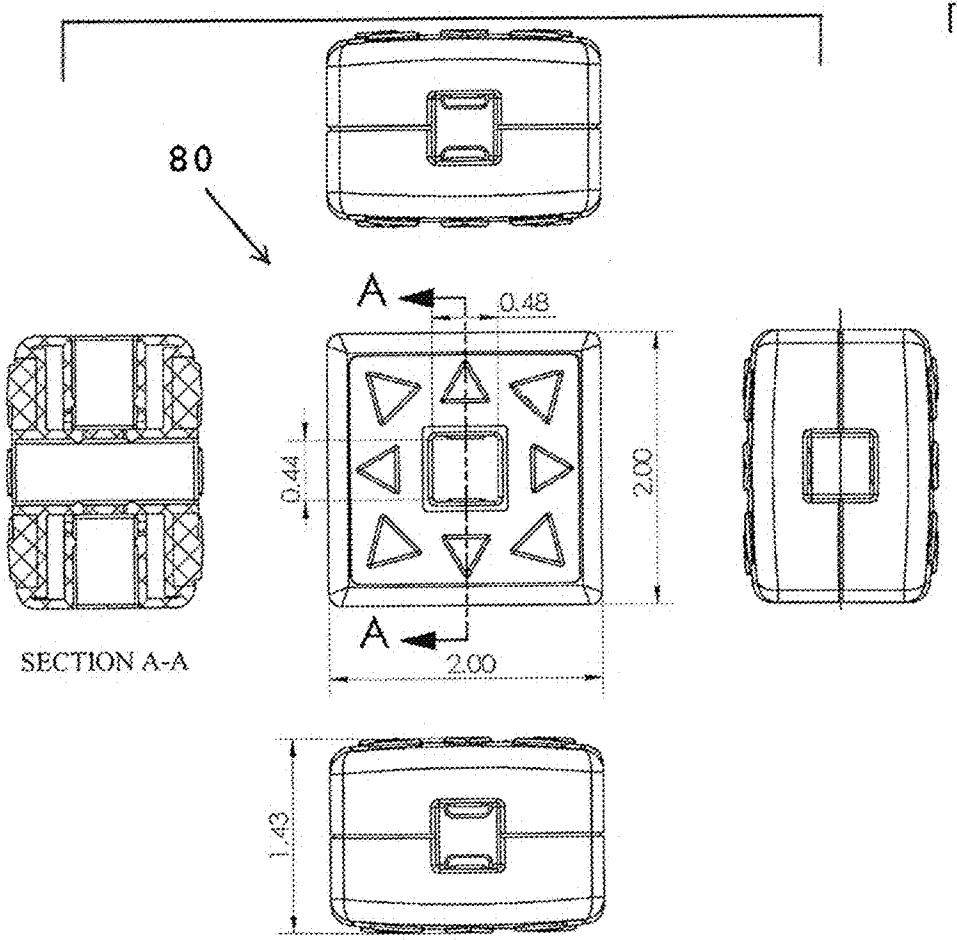
Figure 7B:
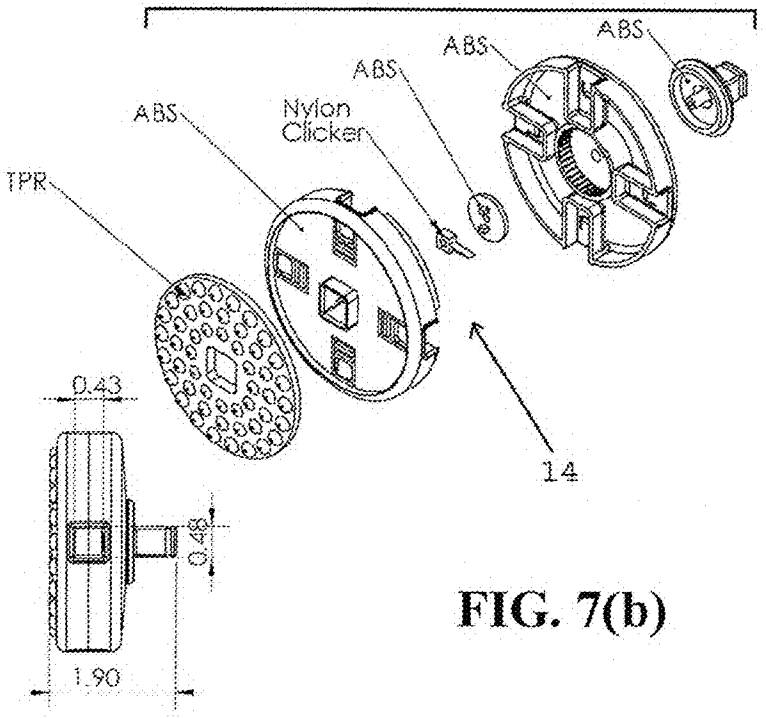
Figure 7A:
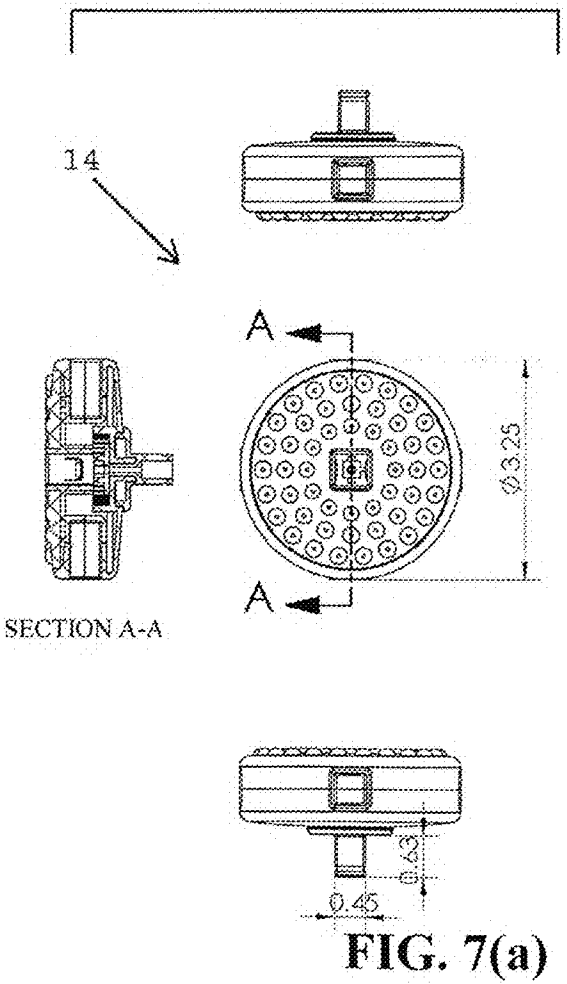
Figure 8B:
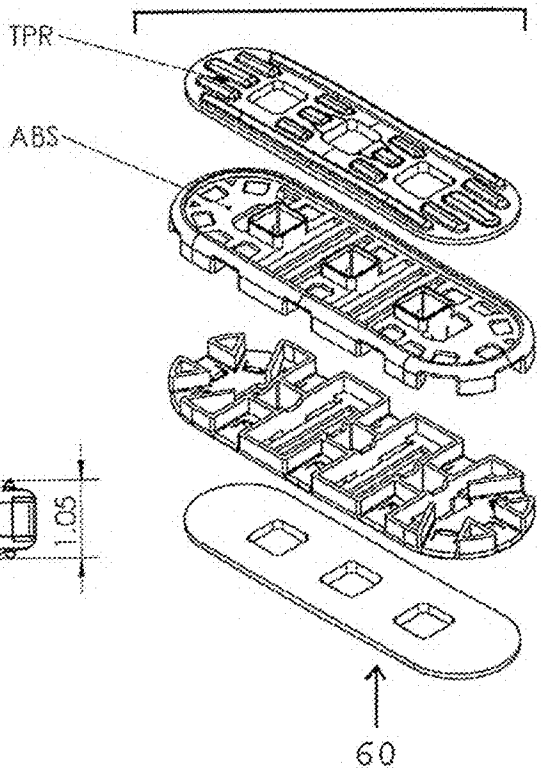
Figure 8A:
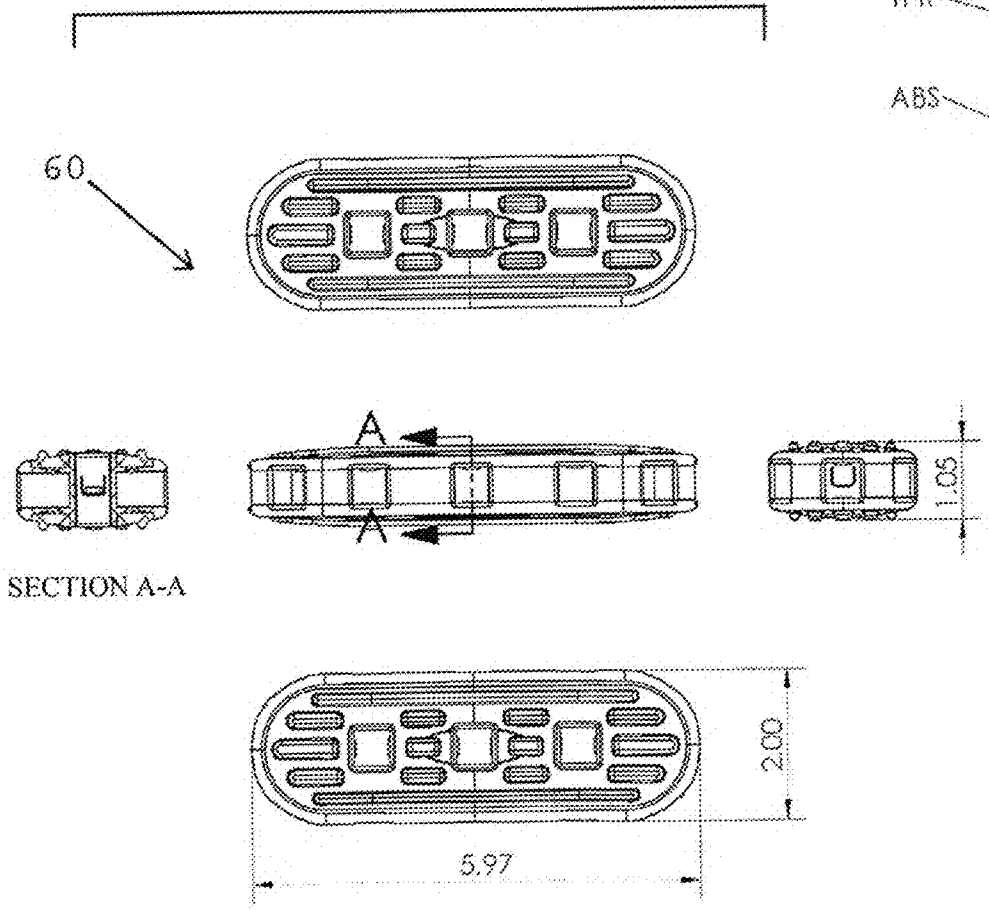
Figure 9B:
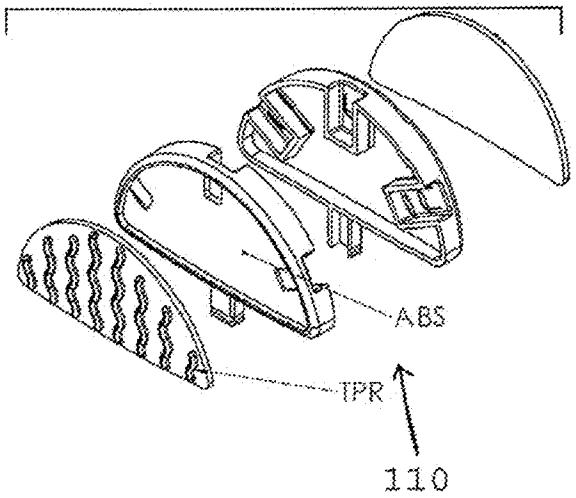
Figure 9A:
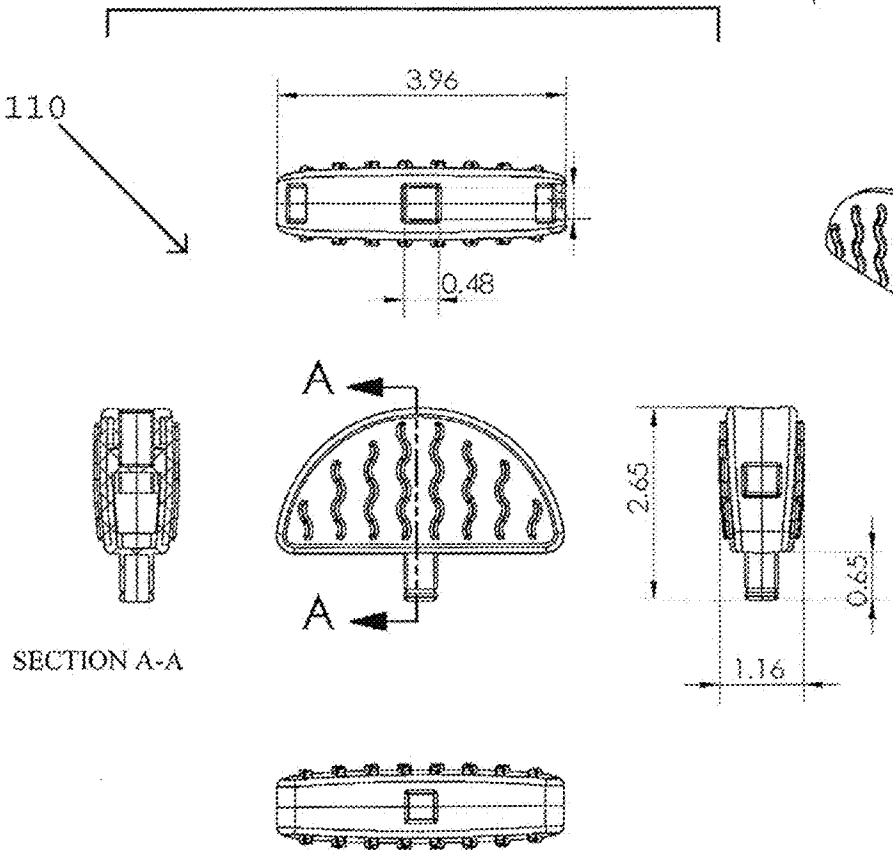
Figure 10B:
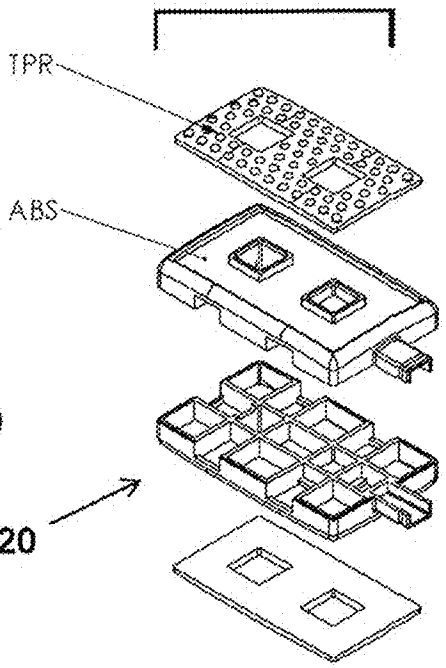
Figure 10A:
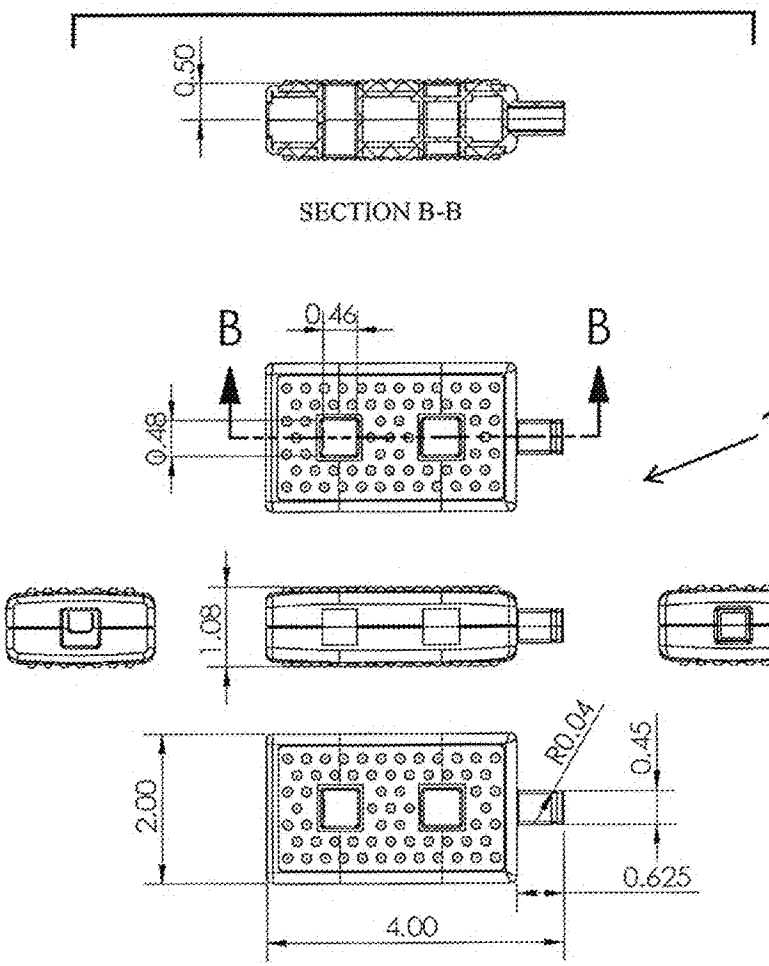
Figure 11B:
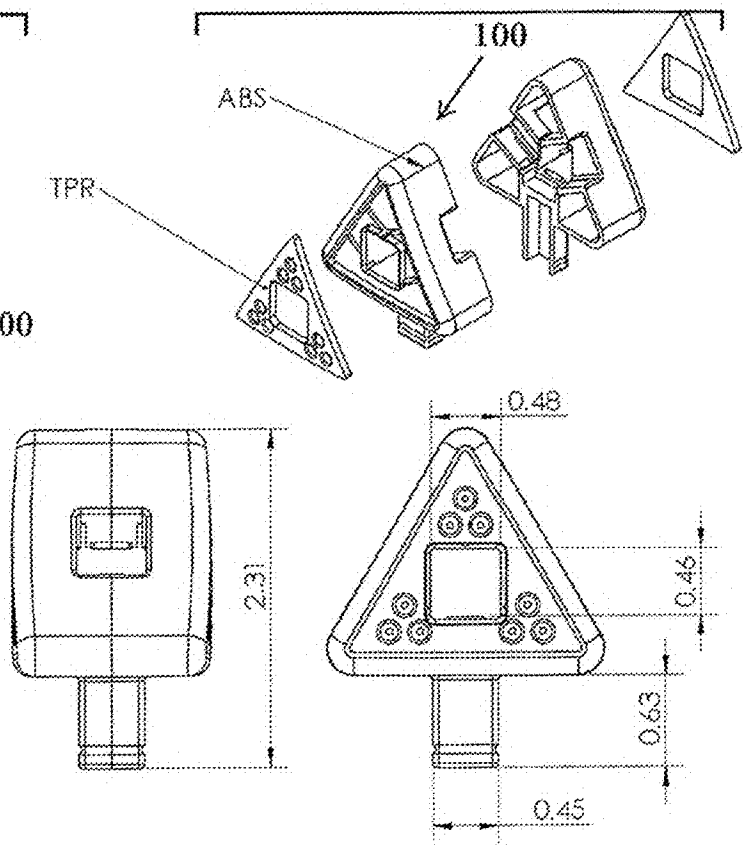
Figure 11A:
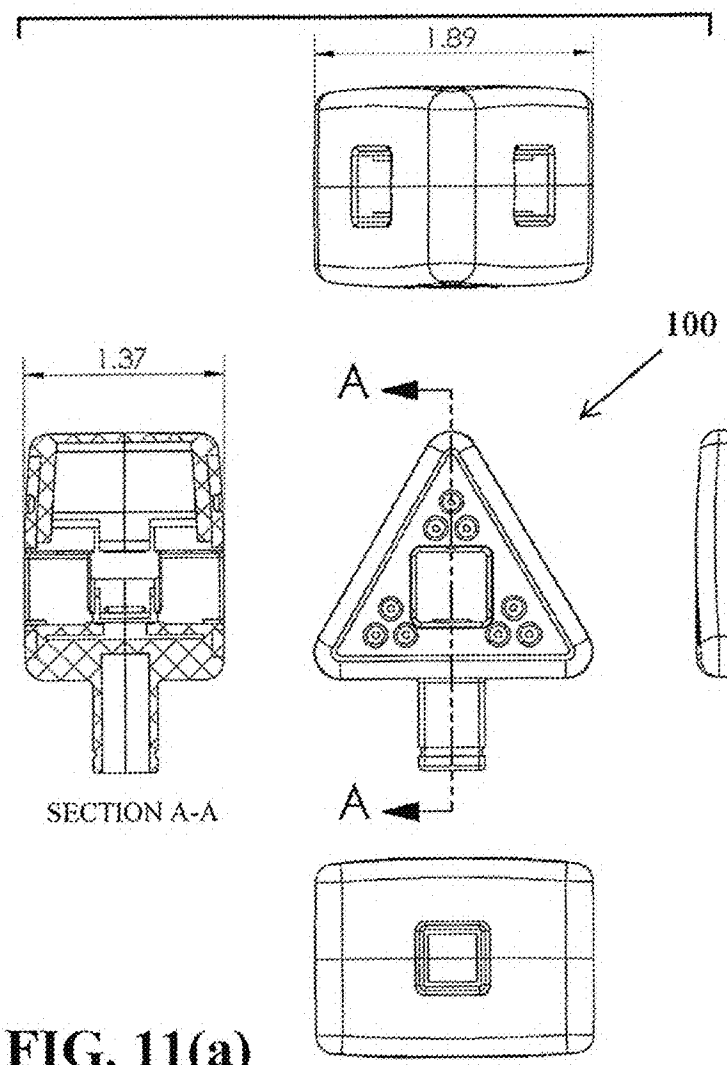
Figure 12B:
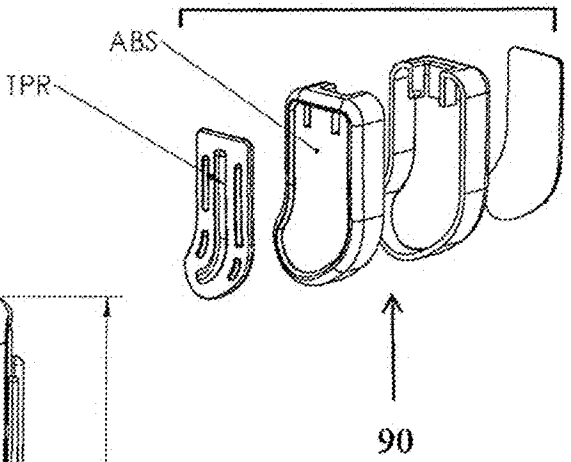
Figure 12A:
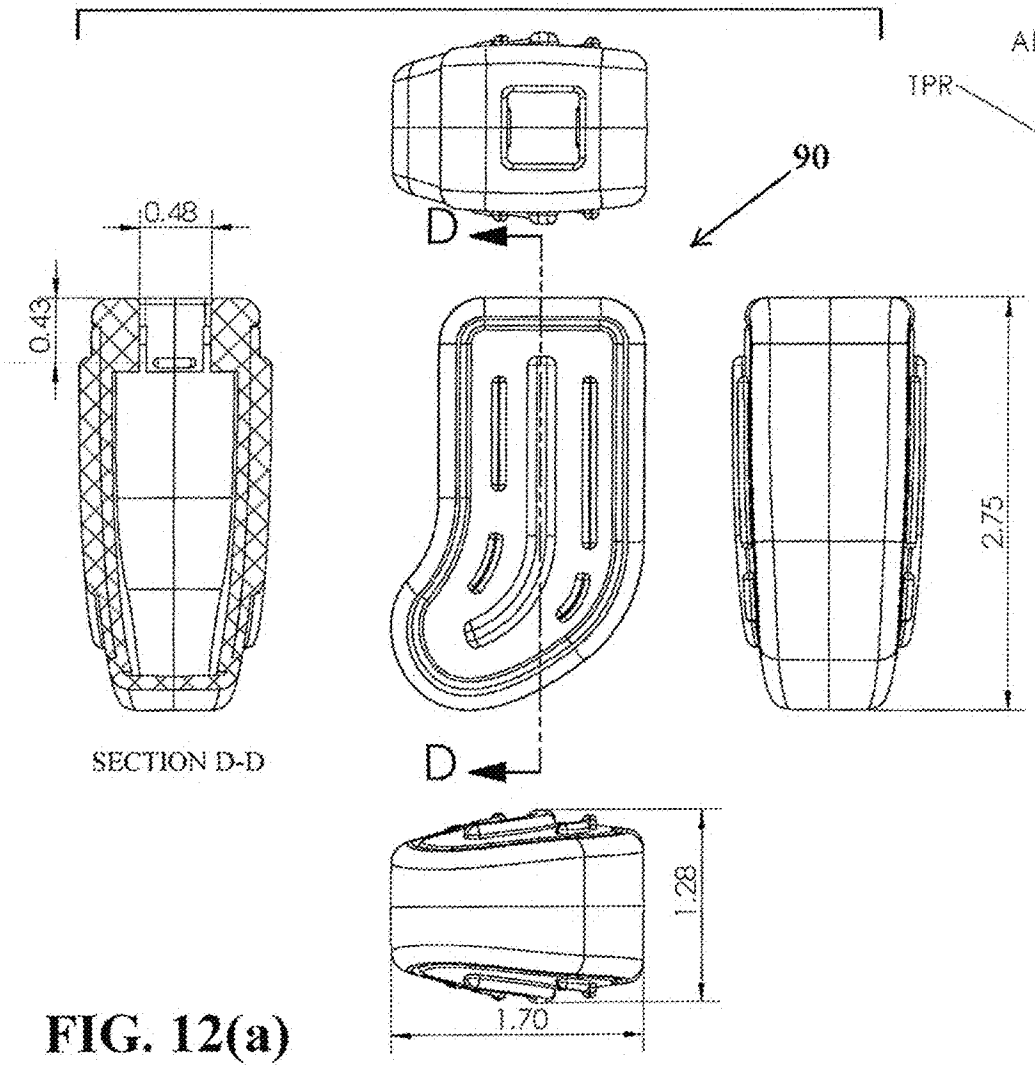
Figure 13B:
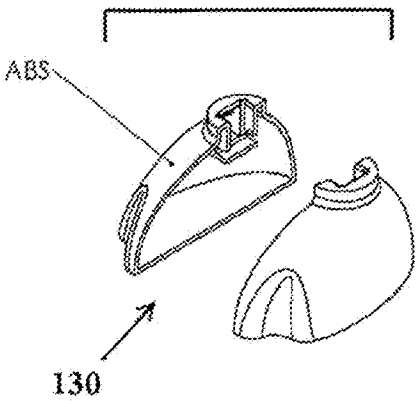
Figure 13A:
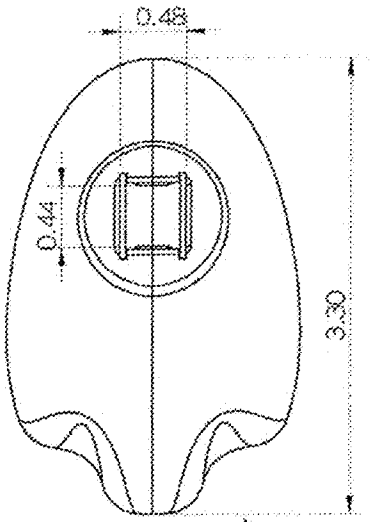
Figure 13A:
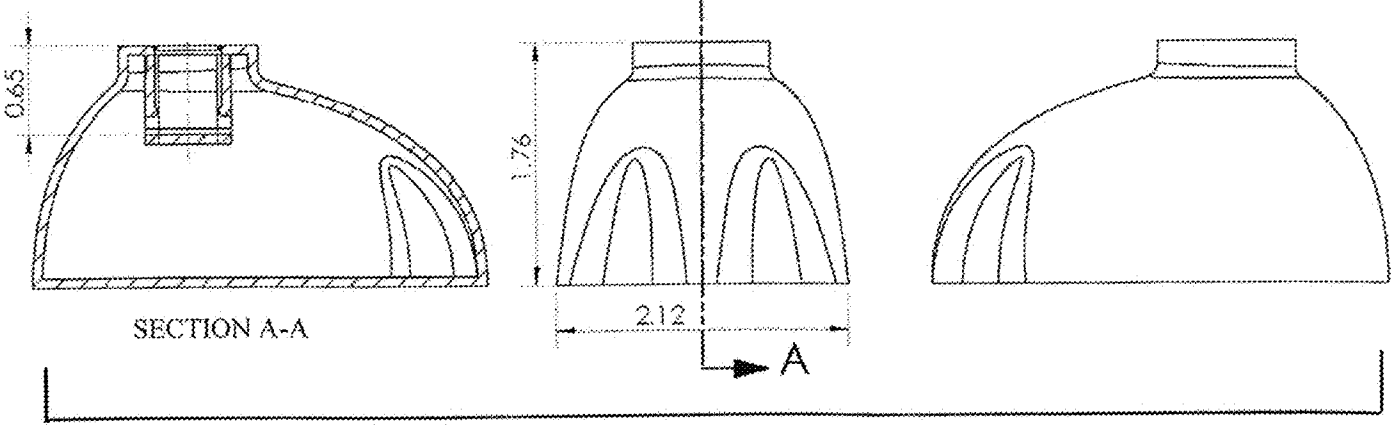
Figure 14B:
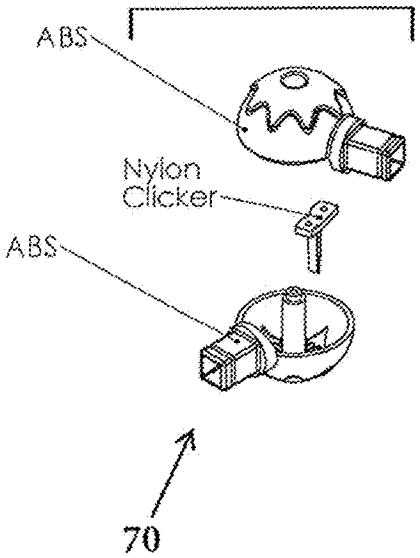
Figure 14A:
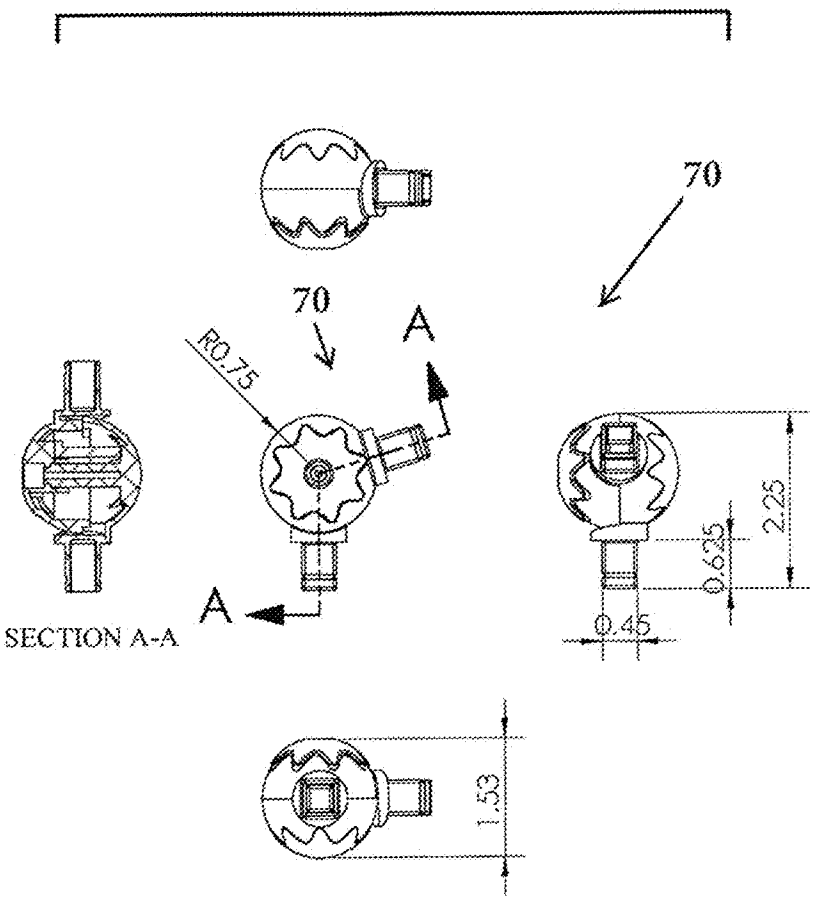
Figure 15B:
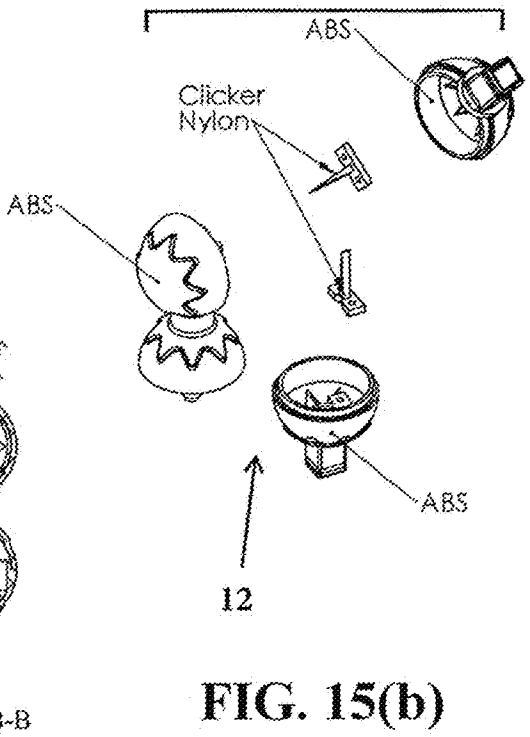
Figure 15A:
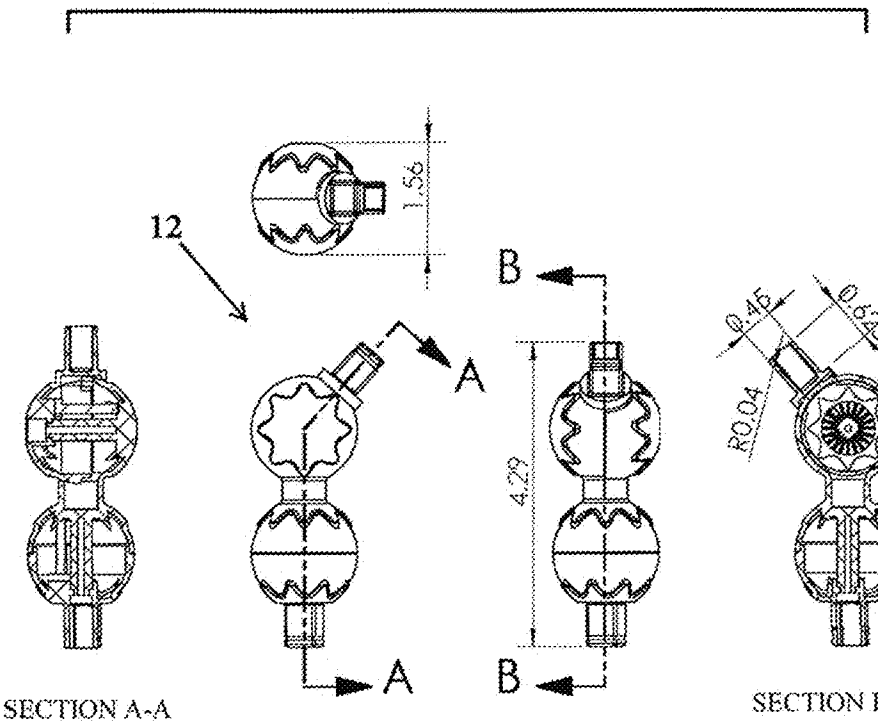
Figure 15A:
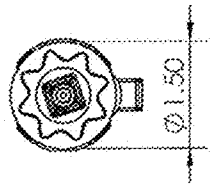
Figure 16B:
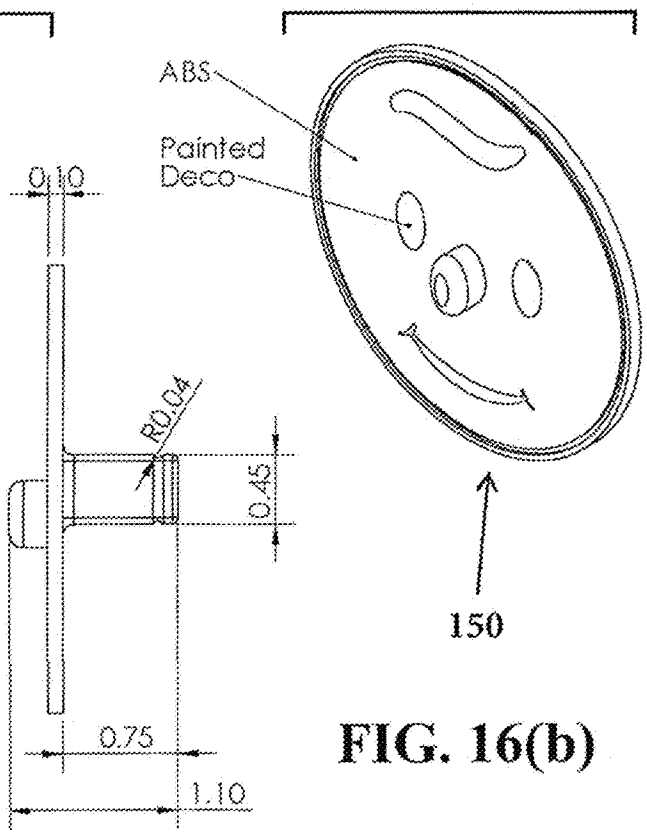
Figure 16A:
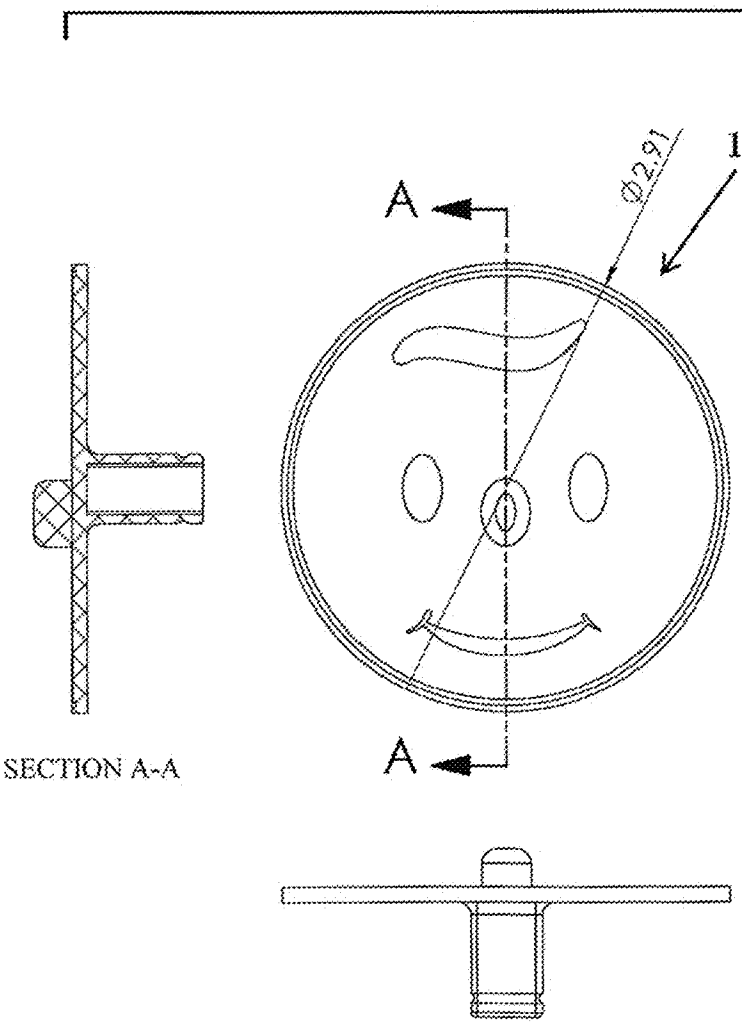
Figure 17B:
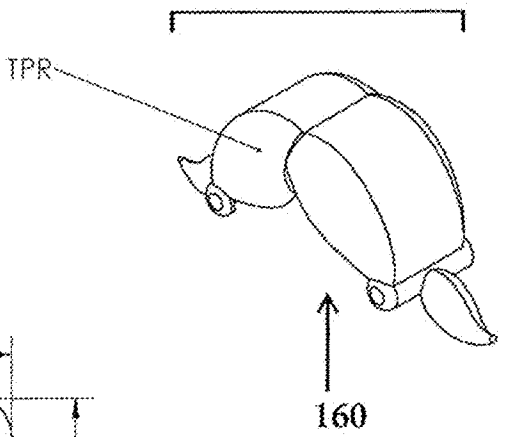
Figure 17A:
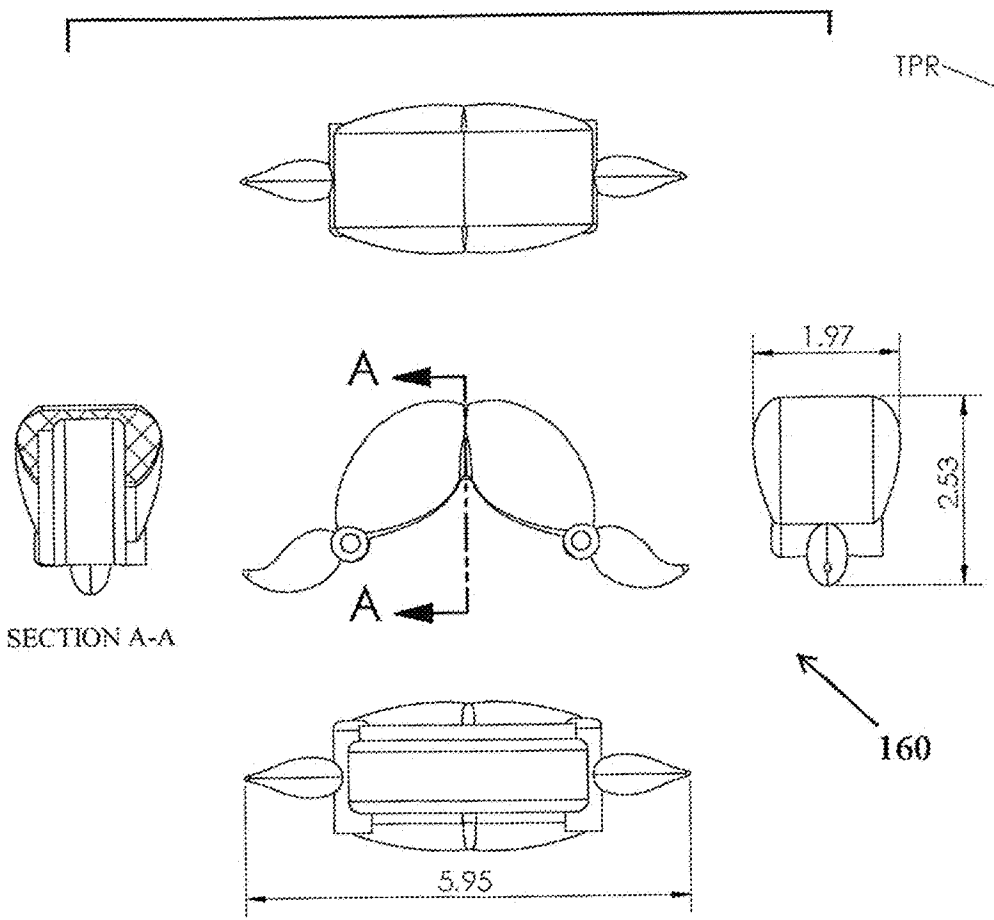
Figure 18B:
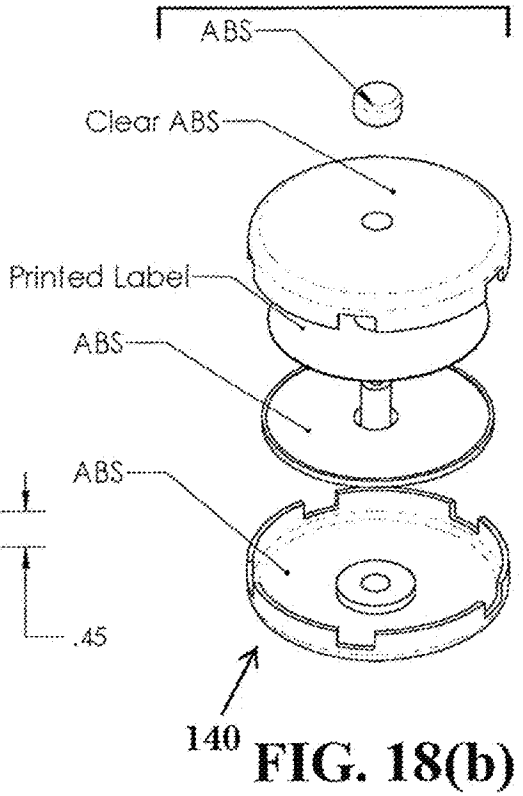
Figure 18A:
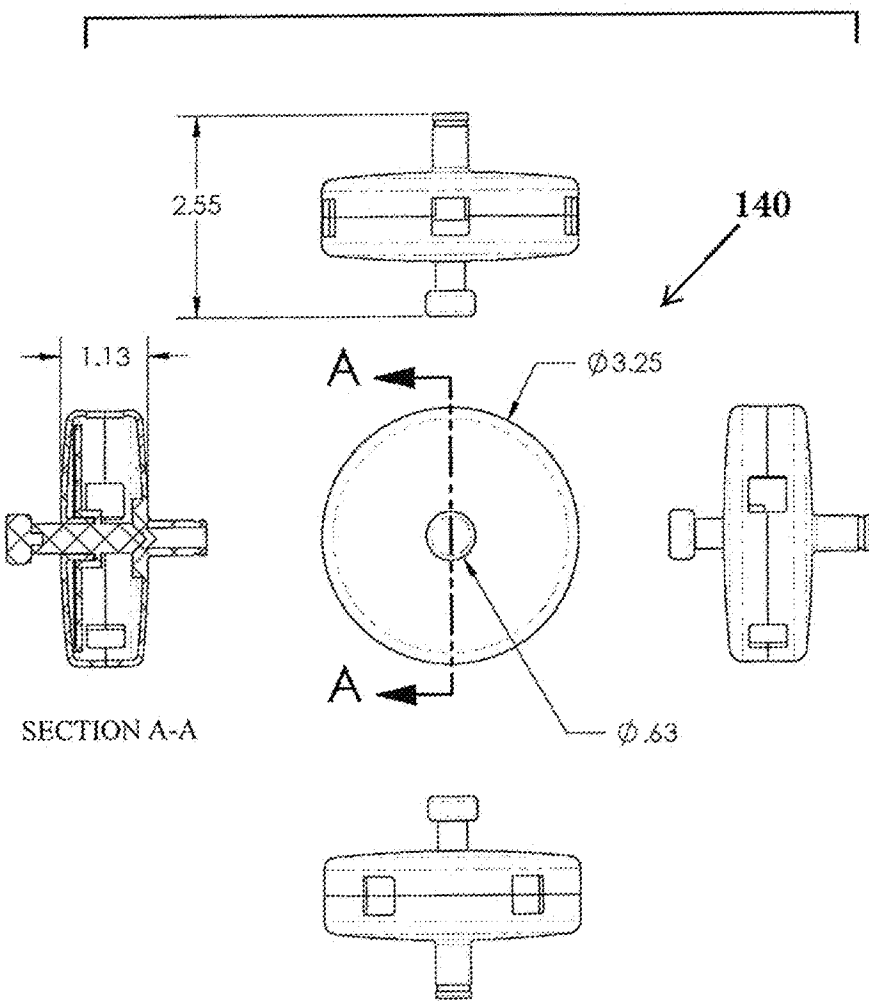
Figure 19:
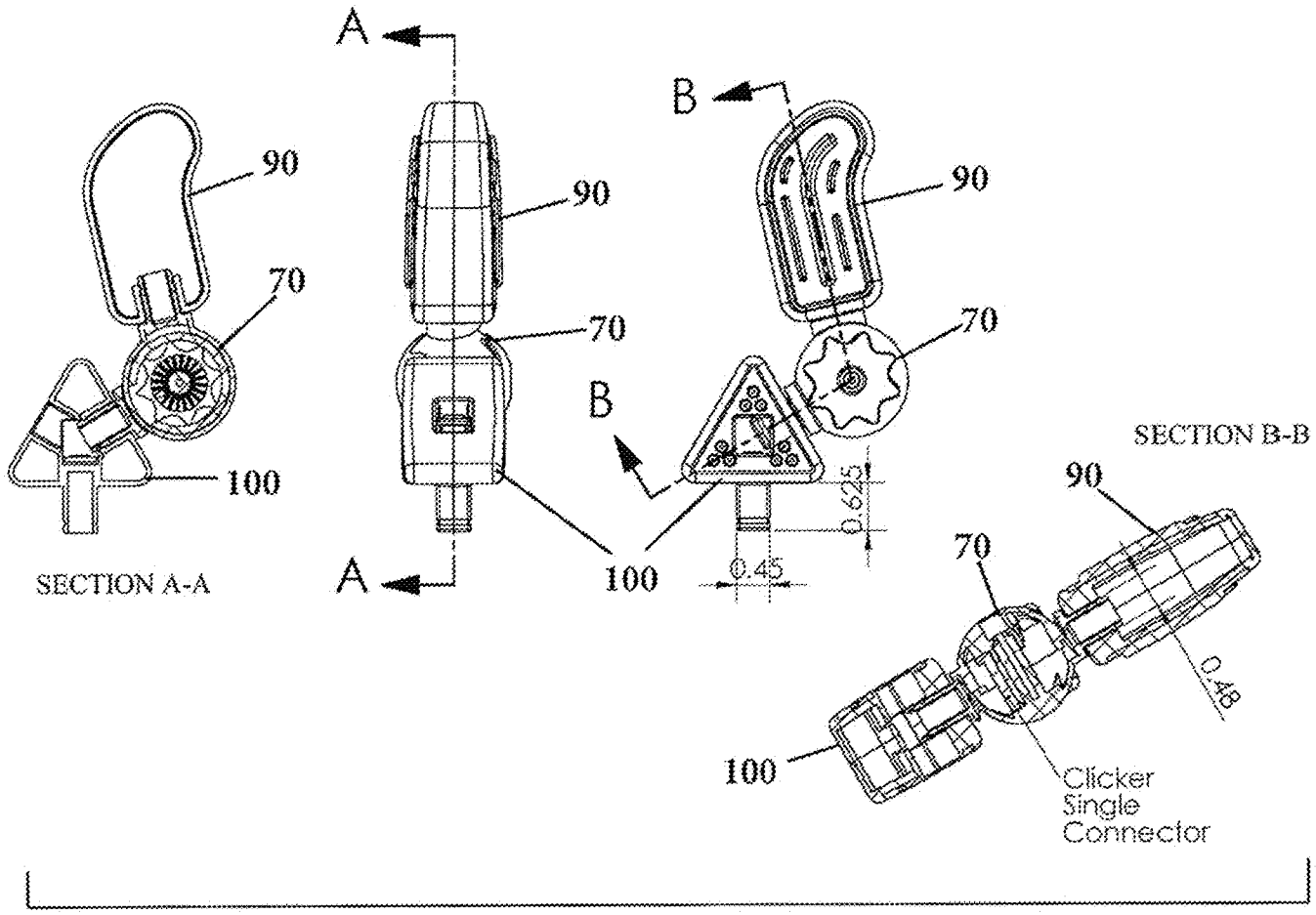

FIGS. 6(*a*) and 6(*b*) are orthographic and assembly views of a square block piece according to the invention;

FIGS. 7(*a*) and 7(*b*) are orthographic and assembly views of a round or circular block piece according to the invention;

FIGS. 8(*a*) and 8(*b*) are orthographic and assembly views of an oblong block piece according to the invention;

FIGS. 9(*a*) and 9(*b*) are orthographic and assembly views of a half round or semicircular block piece according to the invention;

FIGS. 10(*a*) and 10(*b*) are orthographic and assembly views of a rectangular block piece according to the invention;

FIGS. 11(*a*) and 11(*b*) are orthographic and assembly views of a triangular block piece according to the invention;

FIGS. 12(*a*) and 12(*b*) are orthographic and assembly views of a "J" hand block piece according to the invention;

FIGS. 13(*a*) and 13(*b*) are orthographic and assembly views of a "Dino" foot block piece according to the invention;

FIGS. 14(*a*) and 14(*b*) are orthographic and assembly views of a rotatable joint connector piece according to the invention;

FIGS. 15(*a*) and 15(*b*) are orthographic and assembly views of a dual axis or "X-Y" rotatable joint connector piece according to the invention;

FIGS. 16(*a*) and 16(*b*) are orthographic and perspective views of a "smiley" face piece according to the invention;

FIGS. 17(*a*) and 17(*b*) are orthographic and perspective views of a hair piece according to the invention;

FIGS. 18(*a*) and 18(*b*) are orthographic and assembly views of a color pinwheel piece according to the invention; and FIG. 19 shows orthographic views including sections of the single joint connector piece in FIGS. 14(*a*) & (*b*) when joined to the triangular block piece in FIGS. 11(*a*) & (*b*) and to the foot block piece in FIGS. 13(*a*) & (*b*).

DETAILED DESCRIPTION OF THE INVENTION

Figure 1:
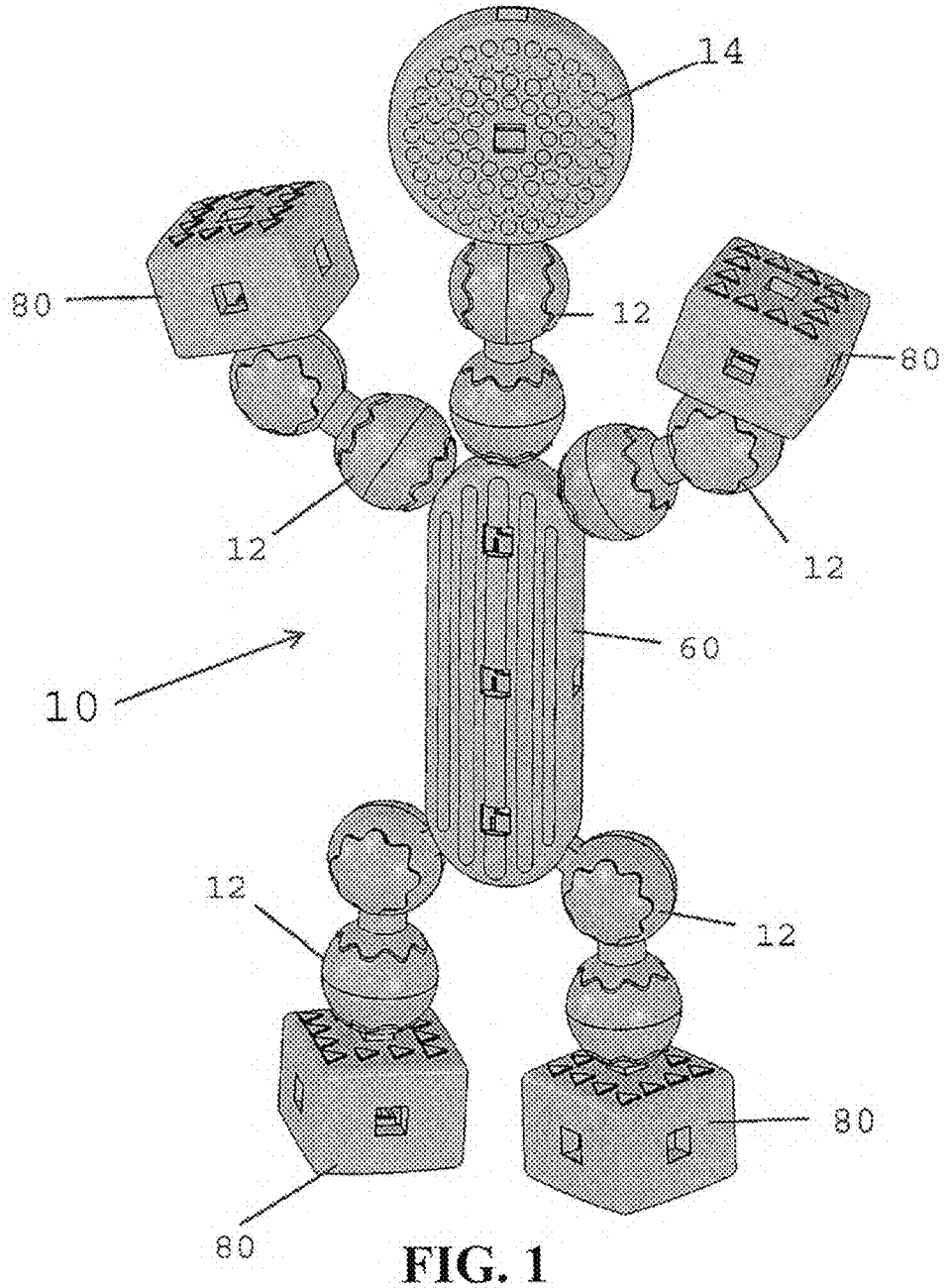
FIG. 1 is a perspective view of a humanoid object that can be assembled from pieces of the inventive toy set.
Figure 2:
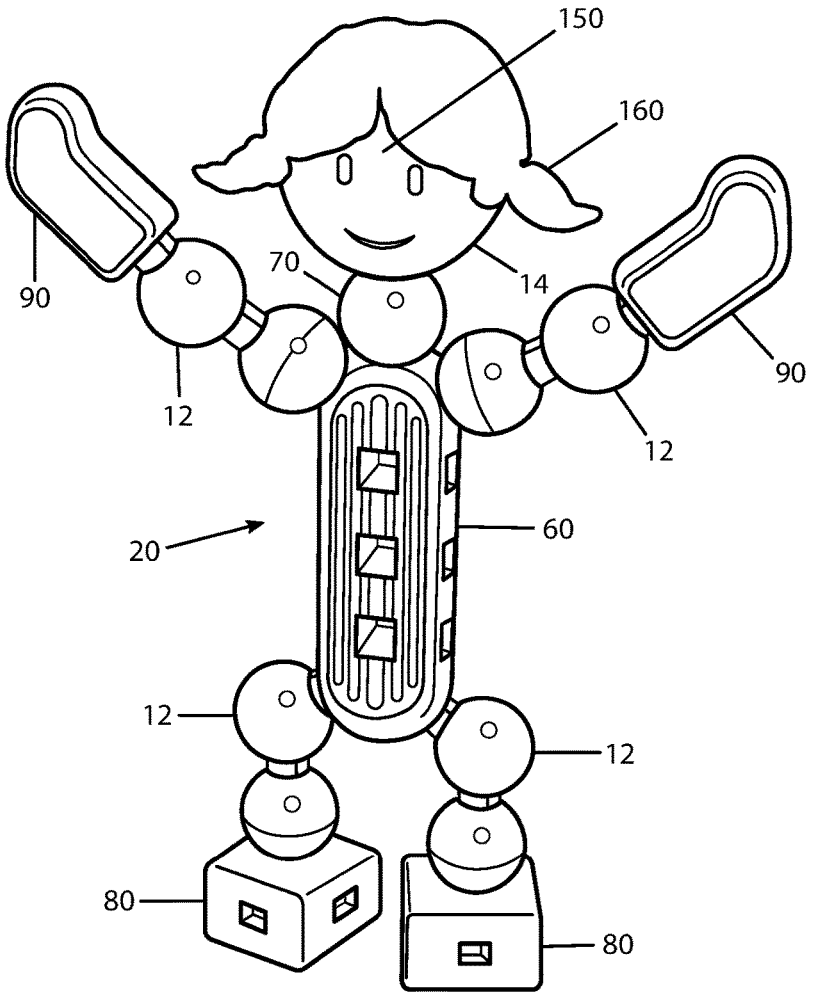
FIG. 2 is a perspective view of a girl model that can be assembled from pieces of the toy set.
Figure 3:
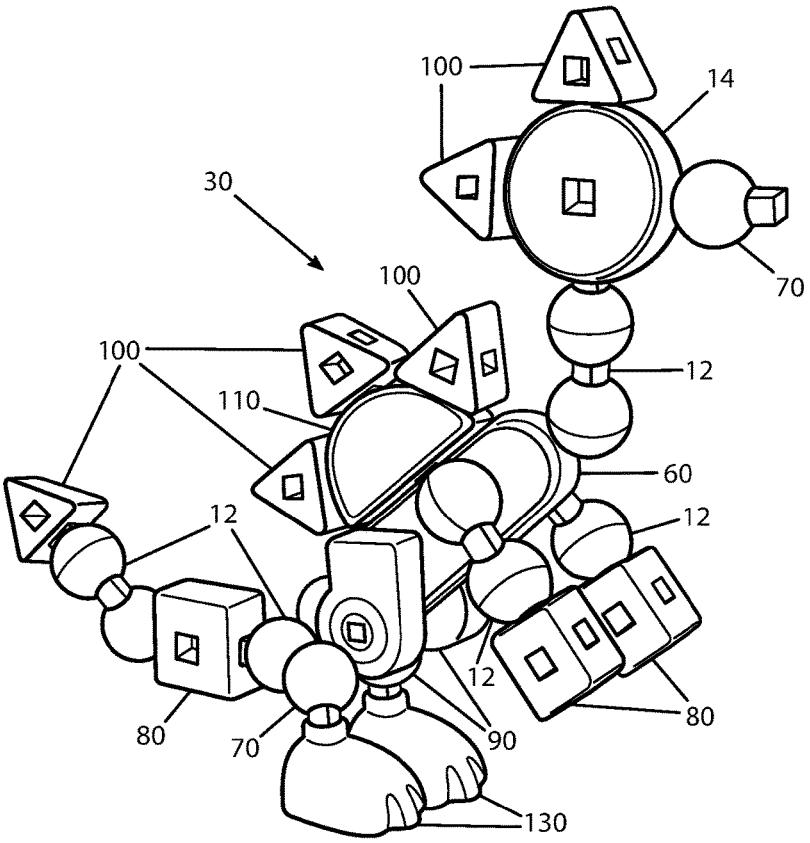
FIG. 3 is a perspective view of a dinosaur model that can be assembled from pieces of the toy set.
Figure 4:
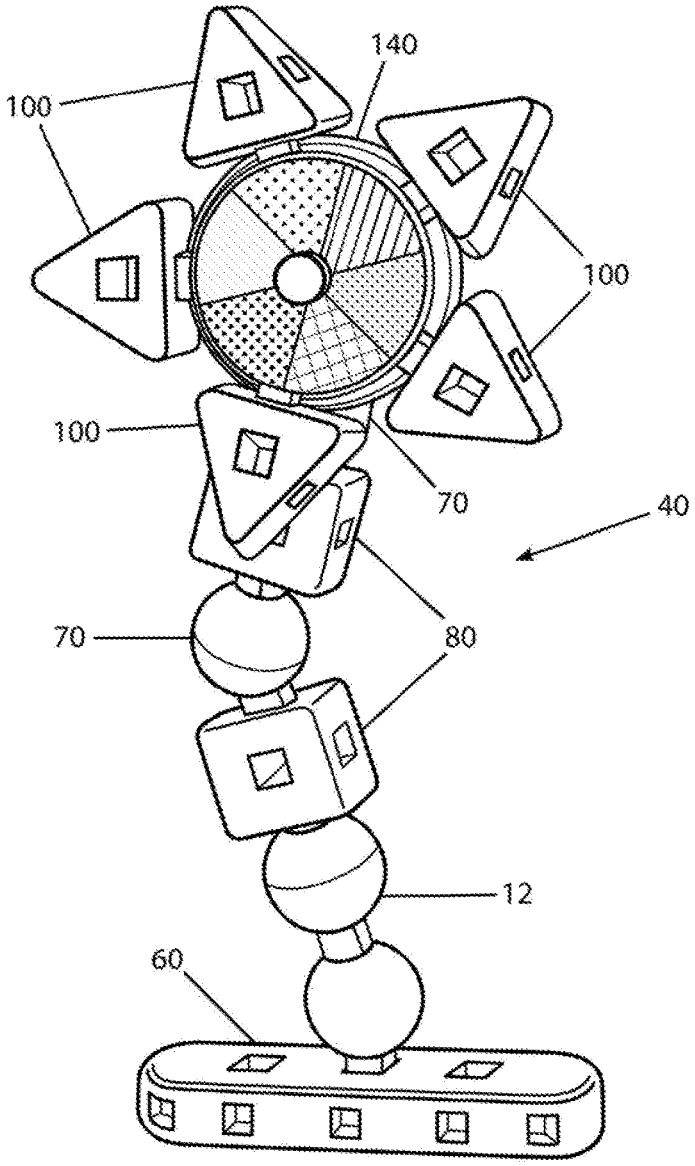
FIG. 4 is a perspective view of a flower model that can be assembled from pieces of the toy set.

FIG. 1 a perspective view of a humanoid object 10 and FIG. 2 is a perspective view of a girl model 20, both of which can be assembled by a toddler or young child using toy block and joint pieces made according to the invention. The object 10 and the model 20 have moveable arms and legs in the form of joint pieces 12 that are capable of rotation about two orthogonal or "X" and "Y" axes. Each joint piece 12 is comprised of two generally spherical bodies that are joined to one another, and each spherical body is formed by two hemispherical parts that are constructed and arranged to rotate relative to one another. The joint pieces 12 are used, for example, to form parts of a dinosaur model 30 in FIG. 3, and a flower model 40 in FIG. 4. Details of the construction of the dual axis rotatable joint piece 12, including typical dimensions, are provided in the views of FIGS. 15(*a*) & (*b*).

The joint pieces 12 and most if not all of the remaining types of pieces described herein can be molded from, e.g., acrylonitrile butadiene styrene (ABS) or a similar plastics material that is safe and meets all applicable rules and standards concerning materials used in children's toys. Many of the remaining pieces also feature a soft outer layer of silicon or thermoplastic rubber (TPR) material that enables a child to grip the piece firmly and comfortably. The exposed surface of the outer layer is also textured in a distinct pattern that a child can learn to associate with each different type of piece. Further, each different type of piece has a bright color that the child can also associate with the piece. For pieces having the textured grip material on their surface, the material may have the same color as the piece but with a different tone or shade (e.g., lighter).

The joint pieces 12 and other types of pieces that can rotate when connected to another piece (for example, a round block piece 14), have internal "click" mechanisms that emit a pleasant, satisfying click-like sound when the piece is turned in response to a moderate force applied by a child. The round block piece 14 simulates a head on the humanoid object 10 and on the girl model 20 in FIGS. 1 and 2, and the piece 14 forms a head for a dinosaur model 30 in FIG. 3. Further details of the round block piece 14 including an internal nylon clicker part, are shown in FIGS. 7(*a*) & (*b*). All dimensions shown in the drawing figures, including FIGS. 7(*a*) & (*b*), are typical only and may be changed within determined limits if desired.

As shown in the various views, the block and the joint pieces of the inventive toy set are joined to one another by way of one or more rectangular plugs formed on one of the pieces to be joined, wherein each plug is dimensioned to be received and to snap fit inside a socket opening formed in the other piece to be joined.

Figure 5:
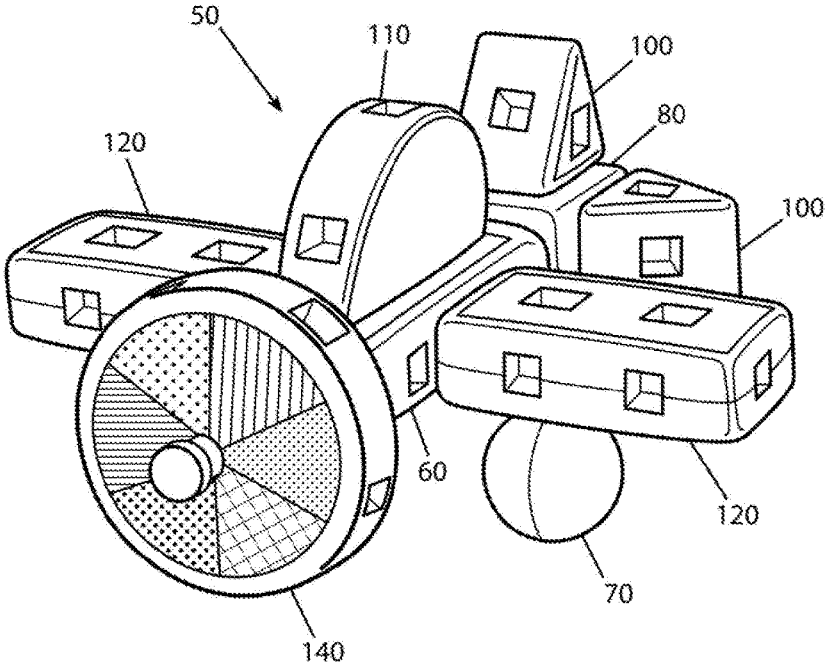
FIG. 5 is a perspective view of an airplane model that can be assembled from pieces of the toy set.

The body of the humanoid object 10, the body of the girl model 20, the body of the dinosaur model 30, the base of the flower model 40, and a fuselage of an airplane model 50 shown in FIG. 5, are all formed by an oblong or disco-rectangular shaped block piece 60. Details of the construction of the oblong block piece 60, including typical dimensions, are provided in the views of FIGS. 8(*a*) & (*b*).

The neck of the girl model 20, and certain parts of the dinosaur model 30, the flower model 40, and the airplane model 50, are formed by a single axis 360 degree rotatable joint piece 70. Details of the construction of the joint piece 70, including typical dimensions, are provided in the views of FIGS. 14(*a*) & (*b*). Further details showing the joint piece 70 when joined with two other pieces of the inventive toy set, described below, are illustrated in FIG. 19.

The hands and the feet of the humanoid object 10, the feet of the girl model 20, and certain parts of the dinosaur model 30, the flower model 40, and the airplane model 50, are simulated by square block pieces 80. Details of the construction of the block piece 80, including typical dimensions, are provided in the views of FIGS. 6(*a*) & (*b*).

The hands of the girl model 20 are simulated by a "J" hand block piece 90. Details of the construction of the block piece 90, including typical dimensions, are shown in the views of FIGS. 12(*a*) and 12(*b*).

Triangle block pieces 100 form parts of the dinosaur model 30, the flower model 40, and the airplane model 50. Details of the construction of the block piece 100, including typical dimensions, are shown in the views of FIGS. 11(*a*) and 11(*b*).

Half round block pieces 110 form parts of the dinosaur model 30, and the airplane model 50. Details of the construction of the block piece 110, including typical dimensions, are shown in the views of FIGS. 9(*a*) and 9(*b*).

Rectangle block pieces 120 simulate wings on the airplane model 50. Details of the construction of the block piece 120, including typical dimensions, are shown in the views of FIGS. 10(*a*) and 10(*b*).

The feet of the dinosaur model 30 are simulated by a dino foot piece 130. Details of the construction of the foot piece 130, including typical dimensions, are shown in the views of FIGS. 13(*a*) and 13(*b*).

A color pin wheel piece 140 forms the head in the flower model 40 and the propeller of the airplane model 50. Details of the construction of the pin wheel piece 140, including typical dimensions, are shown in the views of FIGS. 18(*a*) and 18(*b*).

A face on the head of the girl model 20 is simulated by a face piece 150 which, as shown in FIG. 2, is inserted via a central rectangular plug 152 into a central socket opening formed in the round block piece 14. Details of the construction of the face piece 150 with the plug 152, including typical dimensions, are shown in the views of FIGS. 16(*a*) and 16(*b*).

FIGS. 17(*a*) & (*b*) are views showing details of a hair piece 160 that can be fastened atop the round block piece 14 which forms the head of the girl model 20 in FIG. 2.

The inventive construction toy set fosters creativity in young children by encouraging them to build an object or model using the various block and joint pieces disclosed herein. Importantly, once a child constructs an object, the object can be easily disassembled and later reassembled by the child as often as he or she desires. Moreover, the inventive toy set stimulates the child's senses in terms of touch, feel, and sound as pieces of the objects are assembled, and while the child plays or interacts with the finished object.

While the foregoing represents preferred embodiments of the invention, it will be understood by those skilled in the art that various modifications, changes, and additions may be made without departing from the spirit and scope of the invention, and that the invention includes all such modifications, changes, and additions that are within the scope of the following claims.

We claim:

1. A construction toy set, comprising:

a number of pieces having different shapes, wherein the pieces are dimensioned and configured to enable a user to connect selected pieces to one another to construct a desired object or model;

one or more of the pieces is a first joint piece having an axis, wherein the first joint piece is constructed and arranged to connect first and second other pieces of the toy set to one another for relative rotational movement about the axis of the first joint piece; and the first joint piece has a generally spherical shape and is comprised of two hemispherical parts joined for relative rotation about the axis of the first joint piece, wherein one of the hemispherical parts is configured to connect to the first other piece of the toy set, and the other one of the hemispherical parts is configured to connect to the second other piece of the toy set.

2. A construction toy set according to claim 1, wherein the first joint piece includes a click mechanism constructed and arranged to emit a click-like sound when the hemispherical parts of the piece are rotated relative to one another in response to a force applied by the user.

3. A construction toy set according to claim 1, wherein certain pieces of the toy set are colored according to the shape of the piece, and have a relatively soft textured material on a surface of the piece to facilitate gripping the piece by the user, and an exposed surface of the textured material on a piece of a given shape has a textured pattern which is distinguishable from textured patterns provided on pieces having other shapes.

4. A construction toy set according to claim 3, wherein the textured material comprises thermoplastic rubber (TPR).

5. A construction toy set according to claim 1, wherein certain pieces of the set other than the first joint piece are constructed and arranged to be rotatable relative to one another when the pieces are connected to one another.

6. A construction toy set according to claim 5, wherein one or more of the certain pieces include a click mechanism constructed and arranged to emit a click-like sound when the pieces are rotated in response to a force applied by the user.

7. A construction toy set according to claim 1, wherein one or more pieces of the set have a shape selected from among round, half round, oblong, rectangular, disco-rectangular, square, and triangular.

8. A construction toy set according to claim 1, wherein one or more pieces of the set resemble at least one of a hand, a foot, a face, and hair.

9. A construction toy set according to claim 1, including one or more pieces in the form of a color wheel.

10. A construction toy set according to claim 1, wherein pieces of the set are molded from acrylonitrile butadiene styrene (ABS).

11. A construction toy set according to claim 1, wherein:

one or more of the pieces is a second joint piece having a first axis, and a second axis orthogonal to the first axis;

the second joint piece is constructed and arranged to connect first and second other pieces of the toy set to one another for relative rotational movement about the first and the second axes of the second joint piece; and the second joint piece includes first and second generally spherical bodies joined to one another, wherein;

the first spherical body of the second joint piece includes two hemispherical parts joined for relative rotation about the first axis of the second joint piece, and one of the hemispherical parts of the first spherical body is configured to connect to the first other piece of the toy set, and the second spherical body of the second joint piece includes two hemispherical parts joined for relative rotation about the second axis of the second joint piece, and one of the hemispherical parts of the second spherical body is configured to connect to the second other piece of the toy set.

12. A construction toy set according to claim 11, wherein each of the spherical bodies of the second joint piece includes a click mechanism constructed and arranged to emit a click-like sound when the hemispherical parts of the body are turned relative to one another in response to a force applied by the user.

13. A construction toy set, comprising:

a number of pieces having different shapes, wherein the pieces are dimensioned and configured to enable a user to connect selected pieces to one another to construct a desired object or model;

one or more of the pieces is a first joint piece having an axis, wherein the first joint piece is constructed and arranged to connect first and second other pieces of the toy set to one another for relative rotational movement about the axis of the first joint piece; and the first joint piece has a body comprised of two parts joined to one another for relative rotation about the axis of the first joint piece, wherein one of the parts is configured to connect to the first other piece of the toy set, and the other one of the parts is configured to connect to the second other piece of the toy set, wherein the first joint piece includes a click mechanism constructed and arranged to emit and click-like sound when the parts of the body of the joint piece are rotated relative to one another in response to a force applied by the user.

14. A construction toy set according to claim 13, wherein certain pieces of the toy set are colored according to the shape of the piece, and have a relatively soft textured material on a surface of the piece to facilitate gripping the piece by the user, and an exposed surface of the textured material on a piece of a given shape has a textured pattern which is distinguishable from textured patterns provided on pieces having other shapes.

15. A construction toy set according to claim 14, wherein the textured material comprises thermoplastic rubber (TPR).

16. A construction toy set according to claim 13, wherein certain pieces of the set other than the first joint piece are constructed and arranged to be rotatable relative to one another when the pieces are connected to one another.

17. A construction toy set according to claim 16, wherein one or more of the certain pieces include a click mechanism constructed and arranged to emit a click-like sound when the pieces are rotated in response to a force applied by the user.

18. A construction toy set according to claim 13, wherein one or more pieces of the set have a shape selected from among round, half round, oblong, rectangular, disco-rectangular, square, and triangular.

19. A construction toy set according to claim 13, wherein one or more pieces of the set resemble at least one of a hand, a foot, a face, and hair.

20. A construction toy set according to claim 13, including one or more pieces in the form of a color wheel.

21. A construction toy set according to claim 13, wherein:

one or more of the pieces is a second joint piece having a first axis, and a second axis orthogonal to the first axis;

the second joint piece is constructed and arranged to connect first and second other pieces of the toy set to one another for relative rotational movement about the first and the second axes of the second joint piece; and the second joint piece includes first and second bodies joined to one another, wherein;

the first body of the second joint piece comprises two parts joined to one another for relative rotation about the first axis of the second joint piece, and one of the parts of the first body is configured to connect to the first other piece of the toy set, and the second body of the second joint piece comprises two parts joined to one another for relative rotation about the second axis of the second joint piece, and one of the parts of the second body is configured to connect to the second other piece of the toy set.

22. A construction toy set according to claim 21, wherein each body of the second joint piece includes a click mechanism constructed and arranged to emit a click-like sound when the parts of the joint body are turned relative to one another in response to a force applied by the user.

23. A construction toy set according to claim 13, wherein pieces of the set are molded from acrylonitrile butadiene styrene (ABS).

* * * * *